US010799756B2

(12) United States Patent
Tuononen et al.

(10) Patent No.: US 10,799,756 B2
(45) Date of Patent: Oct. 13, 2020

(54) REHABILITATION DEVICE AND ITS USE FOR EXERCISING THE SHOULDER REGION

(71) Applicant: DAVID HEALTH SOLUTIONS LTD., Helsinki (FI)

(72) Inventors: Jaakko Tuononen, Outokumpu (FI); Johannes Hautamäki, Espoo (FI); Arno Parviainen, Helsinki (FI)

(73) Assignee: DAVID HEALTH SOLUTIONS LTD., Helsinki (FI)

( * ) Notice: Subject to any disclaimer, the term of this patent is extended or adjusted under 35 U.S.C. 154(b) by 106 days.

(21) Appl. No.: 16/088,982

(22) PCT Filed: Apr. 3, 2017

(86) PCT No.: PCT/FI2017/050235
§ 371 (c)(1),
(2) Date: Sep. 27, 2018

(87) PCT Pub. No.: WO2017/174871
PCT Pub. Date: Oct. 12, 2017

(65) Prior Publication Data

US 2019/0054346 A1 Feb. 21, 2019

(30) Foreign Application Priority Data

Apr. 4, 2016 (FI) ..... 20165284

(51) Int. Cl.
*A63B 23/12* (2006.01)
*A63B 21/062* (2006.01)
(Continued)

(52) U.S. Cl.
CPC ..... *A63B 23/1245* (2013.01); *A61H 1/0281* (2013.01); *A63B 21/0628* (2015.10);
(Continued)

(58) Field of Classification Search
CPC ..... A61H 1/0281; A61H 2201/1614; A61H 2201/1633; A61H 2201/1638;
(Continued)

(56) References Cited

U.S. PATENT DOCUMENTS 5,181,896 A 1/1993 Jones
5,409,438 A * 4/1995 Jones ..... A63B 21/0615 482/100
(Continued)

FOREIGN PATENT DOCUMENTS

DE 102004055842 A1 5/2006
DE 102013006020 A1 10/2014
(Continued)

OTHER PUBLICATIONS

Supplementary European Search Report issued in counterpart EP application No. 17 77 8733, dated Oct. 28, 2019.
(Continued)

*Primary Examiner* — Gary D Urbiel Goldner
(74) *Attorney, Agent, or Firm* — Charles C. Achkar; Ostrolenk Faber LLP.

(57) ABSTRACT

The present invention relates to a rehabilitation device adapted for rehabilitating and/or exercising the shoulder region of a user, as well as to the use of such a rehabilitation device. The device enables an upright position of the upper body during the exercise, and shoulder supports holding the shoulder position of the user stationary during the exercise, in order to direct the muscle activation precisely into the small muscles of the shoulder region.

7 Claims, 2 Drawing Sheets

(51) Int. Cl.

| | |
|---|---|
| ***A61H 1/02*** | (2006.01) |
| ***A63B 23/035*** | (2006.01) |
| ***A63B 24/00*** | (2006.01) |
| ***A63B 22/00*** | (2006.01) |
| ***A63B 21/008*** | (2006.01) |
| ***A63B 21/005*** | (2006.01) |

(52) U.S. Cl.
CPC .... *A63B 23/03533* (2013.01); *A63B 24/0087* (2013.01); *A61H 2201/1614* (2013.01); *A61H 2201/1633* (2013.01); *A61H 2201/1638* (2013.01); *A63B 21/005* (2013.01); *A63B 21/008* (2013.01); *A63B 2022/0094* (2013.01); *A63B 2220/16* (2013.01); *A63B 2225/093* (2013.01); *A63B 2225/096* (2013.01); *A63B 2225/50* (2013.01); *A63B 2225/54* (2013.01)

(58) Field of Classification Search
CPC ..... A61H 2203/0431; A61H 2205/062; A63B 21/00058; A63B 21/00061; A63B 21/00065; A63B 21/00069; A63B 21/00072; A63B 21/00076; A63B 21/00185; A63B 21/00192; A63B 21/002; A63B 21/0023; A63B 21/005; A63B 21/0051; A63B 21/0052; A63B 21/0056; A63B 21/0057; A63B 21/008; A63B 21/0083; A63B 21/0084; A63B 21/00845; A63B 21/0085; A63B 21/0087; A63B 21/062; A63B 21/0622; A63B 21/0624; A63B 21/0626; A63B 21/0628; A63B 21/063; A63B 21/0632; A63B 21/065; A63B 21/068; A63B 21/08; A63B 21/15; A63B 21/159; A63B 21/22; A63B 21/4005; A63B 21/4017; A63B 21/4027; A63B 21/4029; A63B 21/4031; A63B 21/4033; A63B 21/4035; A63B 21/4041; A63B 21/4045; A63B 21/4047; A63B 21/4049; A63B 22/0002; A63B 22/0005; A63B 22/0025; A63B 22/0046; A63B 22/0048; A63B 22/0064; A63B 22/0066; A63B 22/0069; A63B 2022/0028; A63B 2022/0041; A63B 2022/0092; A63B 2022/0094; A63B 23/035; A63B 23/03508; A63B 23/03516; A63B 23/03533; A63B 23/03541; A63B 23/12; A63B 23/1209; A63B 23/1245; A63B 23/1254; A63B 23/1263; A63B 23/1272; A63B 23/1281; A63B 24/0087; A63B 2024/0093; A63B 26/00; A63B 26/003; A63B 69/0057; A63B 69/0069; A63B 2208/0228; A63B 2208/0233; A63B 2220/10; A63B 2220/16185; A63B 2220/51; A63B 2220/52; A63B 2220/54; A63B 2220/58; A63B 2225/09; A63B 2225/093; A63B 2225/096; A63B 2225/15; A63B 2225/20; A63B 2225/50; A63B 2225/52; A63B 2225/54; A63B 2244/09
See application file for complete search history.

(56) References Cited

U.S. PATENT DOCUMENTS

| | | | | |
|---|---|---|---|---|
| 5,417,643 | A | 5/1995 | Taylor | |
| 6,007,500 | A * | 12/1999 | Quintinskie, Jr. | A61H 1/0281 601/33 |
| 7,833,138 | B1 | 11/2010 | Fulks | |
| 8,672,817 | B2 | 3/2014 | Bowser | |
| 9,205,017 | B2 * | 12/2015 | Doyle | B25J 9/0006 |
| 10,265,857 | B2 * | 4/2019 | Sankai | B25J 9/0006 |
| 2003/0115954 | A1 * | 6/2003 | Zemlyakov | A61B 5/022 73/379.01 |
| 2003/0130600 | A1 | 7/2003 | Branch | |
| 2003/0158019 | A1 | 8/2003 | Giannelli | |
| 2007/0225620 | A1 * | 9/2007 | Carignan | A61H 1/0281 601/5 |
| 2008/0058182 | A1 | 3/2008 | Pompile | |
| 2008/0132383 | A1 * | 6/2008 | Einav | A61H 1/02 482/8 |
| 2010/0249673 | A1 * | 9/2010 | Nef | A61H 1/0281 601/33 |
| 2012/0094813 | A1 * | 4/2012 | Berardo | A63B 21/015 482/139 |
| 2012/0184880 | A1 | 7/2012 | Doyle | |
| 2013/0109542 | A1 * | 5/2013 | Hockridge | A63B 21/062 482/94 |
| 2014/0057761 | A1 | 2/2014 | Higgins | |
| 2015/0360069 | A1 | 12/2015 | Marti et al. | |
| 2016/0206497 | A1 * | 7/2016 | Deshpande | A61F 2/78 |
| 2019/0111312 | A1 * | 4/2019 | Taivainen | A63B 24/0087 |

FOREIGN PATENT DOCUMENTS

| | | | |
|---|---|---|---|
| WO | WO 8501446 | A1 | 4/1985 |
| WO | WO 9406518 | A1 | 3/1994 |
| WO | WO 2010071252 | A1 | 6/2010 |
| WO | WO 2011/004410 | A1 | 1/2011 |
| WO | WO 2011104320 | A1 | 9/2011 |
| WO | WO 2012120299 | A1 | 9/2012 |

OTHER PUBLICATIONS

International Search Report issued in International Application No. PCT/FU2017//050235, dated Sep. 5, 2017.
Written Opinion of the International Searching Authority issued in International Application No. PCT/FU2017//050235, dated Sep. 5, 2017.
Finland Search Report issued in priority application No. 20165284, dated Sep. 2, 2016.
Chinese Office Action issued in counterpart CN application No. 201780022078.5 dated Jan. 15, 2020 with English translation thereof.

* cited by examiner

REHABILITATION DEVICE AND ITS USE FOR EXERCISING THE SHOULDER REGION

CROSS REFERENCE TO RELATED APPLICATIONS

The present application is a § 371 National Stage application based on PCT/FI2017/050235 filed Apr. 3, 2017, which claims the benefit of Finland application No. 20165284 filed Apr. 4, 2016, the subject matter of each of which is incorporated by reference in their entirety.

The present invention relates to a device adapted for rehabilitating and/or exercising the shoulder region to prevent, ease and/or heal pains in the shoulder region.

Shoulder pain is a formidable problem worldwide. Of all musculoskeletal problems, shoulder ailments cause the most sick leave absences. Shoulder pain is the most common musculoskeletal ailment in persons over 65 years of age and its prevalence has tripled during the last 40 years. One in every two persons will experience shoulder pains during their lifetime. In spite of these figures, rehabilitating and exercising the shoulder measurably, monitorably and repeatably by a biomechanically optimal method has not been possible.

Devices intended for strengthening the musculature of the shoulder and shoulder region are primarily intended for strengthening the large muscles moving the upper limbs. However, the causes of shoulder problems and pains are generally elsewhere. Most often the cause is found in the weakness of the small muscles supporting the shoulder joint. Traditional rehabilitation devices are not suitable for exercising this so-called rotator cuff.

In physiotherapy, the most important auxiliary device for rehabilitating the rotator cuff is generally the rubber resistance band, by means of which i.a. external and internal shoulder rotation exercises can be executed. During physiotherapy, the therapist teaches the correct techniques for executing exercises, after which rehabilitation takes place primarily at home or in the gym, independently. Performing motions at biomechanically optimal joint angles is difficult using a rubber resistance band, because there are innumerable variables. I.a. the height of the attachment site of the rubber band and the position of the rehabilitee in relation to the attachment site significantly affect the magnitude and direction of the force of the resistance. Furthermore, the greatest disadvantage of the rubber resistance band is the shape of its load curve. As the rubber band lengthens, the resistance it produces increases. The force produced by the muscles to be used in the internal and external rotation of the shoulder by contrast decreases, as the joint angle increases. Thus, the resistance load curve and the force production curve of the muscles to be exercised are complete opposites. This creates a potential risk of injury in healing tissues, particularly with internal rotation exercise of the shoulder.

The use of various pulleys in the rehabilitation and exercise of the shoulder is also quite common. Although the load curve can be modified by changing the position of the body and forearm significantly better than with a rubber resistance band, a disadvantage in using pulleys is created exactly in the control of the angles of the exercise—or rather the lack of control—with independent exercising. Removal of the muscle activation required to carry the hand is also generally not possible when using pulleys.

The select few devices on the market intended for the internal and external rotation of the shoulder use joint angles that are not optimal or they cannot be precisely controlled.

In addition, the load curves of the devices are not optimal. The devices also have no angle or force sensors, wherein the device cannot perform isometric force measurements and the quality of the exercise cannot be monitored. In addition, the devices require several adjustment measures in order to make them to suit for persons of different heights.

US2003130600A presents a device for exercising the shoulder joint. The object of the presented invention is to only passively increase the mobility of the shoulder joint. In other words, the device in question is a stretching device, in which the stretching force is produced by the opposite hand. In the presented invention, shoulder supports are used in an attempt to prevent the shoulder from rising upwards, while the abduction of the upper arm is increased, wherein the motion is directed better into the shoulder joint. However, a device according to this invention cannot be used to execute a dynamic strength exercise, in which a stack of weights is used as the load. In addition, in this device, the shoulders are restrained in place on only one side at a time, unlike in the present invention, in which the restraint occurs on both sides.

WO2012/120299A1 presents a rehabilitation device, which can be used to exercise different muscles, i.a. the internal and external rotators of the shoulder. The idea of the device is to execute the exercise by means of multi-joint motions. The devices can be locked such that they are used to execute only exercises of the internal and external rotators. However, devices according to the invention have extremely complex and time-consuming adjustments, and adjusting the device in the frontal plane is not possible. In addition, joint angles are formed incorrectly or at least not optimally, as do the load curves as well. If there is a desire to exercise by the device using both hands, this will require a second person to fasten the hands to the motion shafts.

The object of the present invention is to obviate above said disadvantages and provide a rehabilitation device, by means of which the internal and external rotator exercises of the shoulder can be executed safely and effectively with optimal joint angles and loads, and directing the muscle activation precisely into the small muscles of the shoulder region such that the large, powerful muscles are not able to aid in executing the motion. The most important object of the invention is to strengthen the musculature stabilizing the shoulder joint by dynamic strength exercise executed by a device according to the invention, in which a weight stack is used as the load. As a result of dynamic strength exercise, the motion ranges also improve.

This object can be achieved by a rehabilitation device according to the invention, to which are arranged shoulder supports on both sides, which direct dynamic work to the small muscles of the rotator cuff, while preventing force production by the large and powerful muscles in the direction of motion of the exercise (particularly in the internal rotation of the shoulder joint).

More specifically, a rehabilitation device according to the invention is characterized by that, which is specified in the characterizing part of claim 1. The use of a device according to the invention for exercising the shoulder region is, in turn, characterized by that, which is specified in the characterizing part of claim 7.

In the following, the present invention is described in more detail by means of reference to the following drawings, in which.

Figure 1:
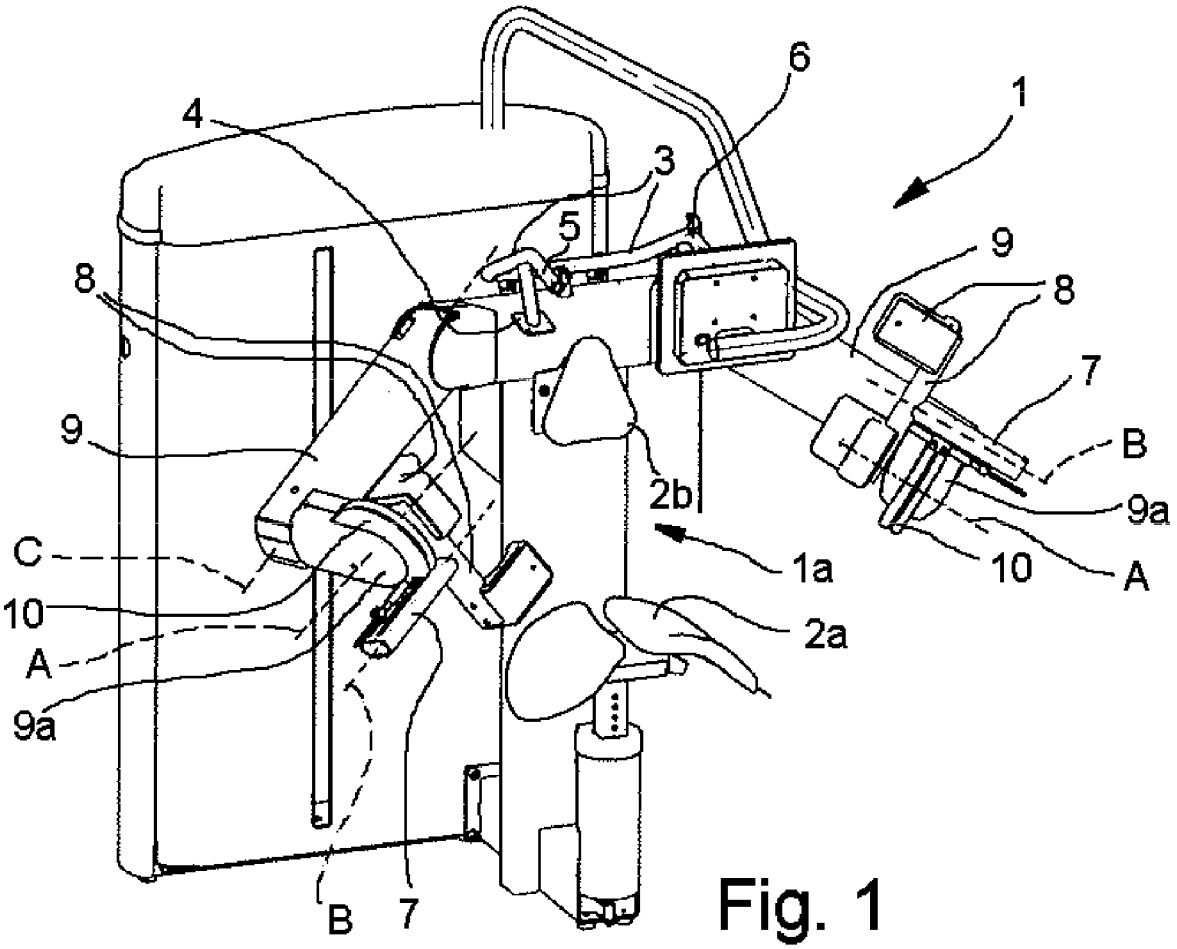
FIG. 1 shows a device according to a preferred embodiment of the invention as a perspective view.
Figure 2:
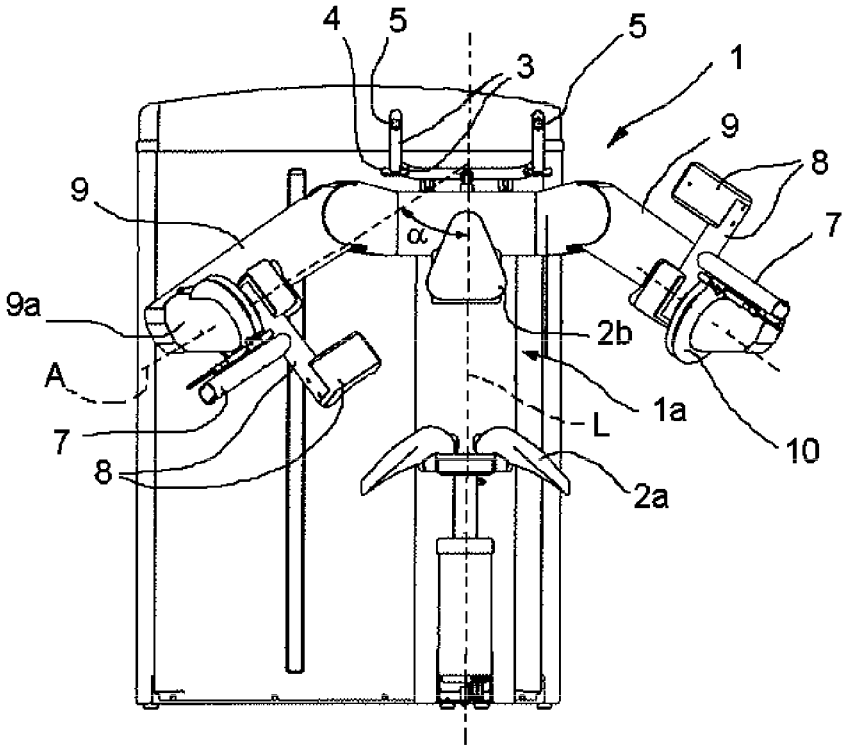
FIG. 2 shows the device of FIG. 1 as viewed from the front.
Figure 3:
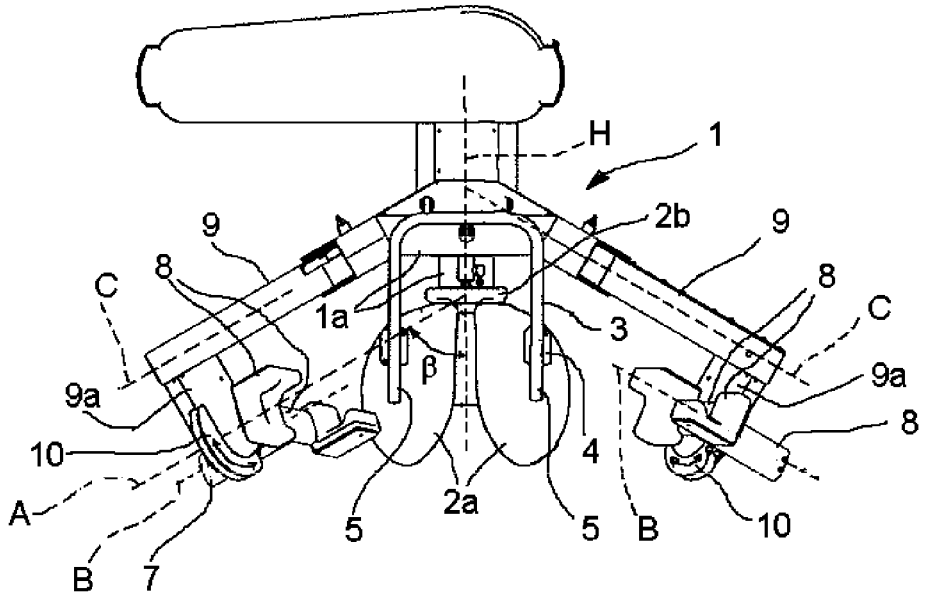
FIG. 3 shows the device of FIGS. 1 and 2 as viewed from above.

A device 1 according to the invention has support means 2*a* and 2*b* allowing the upper body of a user a substantially upright exercise position. During the exercise, the user sits on the seat 2*a*. The seat is preferably of a saddle model, and it is preferably electrically adjustable. The seat is preferably attached directly to the frame 1*a*, but it can be arranged in connection with the device also separately from the frame. Attached to the frame, the backrest 2*b* is shaped like an upward-pointing triangle and its location in the direction of depth is to be adjusted manually or electrically. The intention is not actually to lean against the backrest, rather the backrest defines the correct exercise position. The shape of the backrest is precisely designed such that it does not prevent the rearward motion of the shoulder blades.

When the site of the backrest has been correctly adjusted, the position of the shoulders during exercise is made stationary, for example, by a hinged or articulated shoulder lock 3 from above. The shoulder lock includes shoulder supports 4 settling on top of the shoulders, which prevent forward and upward motion of the shoulders, while preventing an incorrect manner of executing the motion and activation of wrong muscles or portions of muscles, as well as handles 5 and the locking release 6. The shoulder supports 4 are preferably padded. Preventing the forward and upward motion of the shoulders minimizes the force production, especially of the large internal rotators, and especially the large chest muscle (m. pectoralis major), directing activation into the desired muscles. The shoulder locking 3 is preferably arranged as a configuration that simultaneously holds both shoulders stationary, but the device can also be implemented with separate shoulder supports for each of the shoulders. The rehabilitee himself pulls the shoulder supports 4 by hand down from above onto his shoulders by pulling from the handles 5. The locking of the shoulder supports is achieved, for example, by a mechanical locking. The locking is released by a trigger 6, which is disposed to the handles, or preferably to only one of the handles. Such a locking of the rehabilitation device and its releasing trigger are known to the skilled persons in the art, and they are not presented in more detail in this connection.

The elbows and forearms are disposed into the elbow supports 8 at the ends of the motion shafts 7, which carry the arms in the region of the elbow and forearm. This is extremely important for the exercise in order that the muscles carrying the hands, such as the upper portions of the trapezius muscles (m. trapezius), do not activate. Using rubber bands, pulleys or free weights this is not possible. The elbow supports 8 are designed such that it is easy to settle the elbows and forearms into the exercise position regardless of the shoulder supports 4 holding the shoulders stationary, and this does not cause shoulder patients additional pain. To the elbow supports are preferably arranged paddings 11, the location and design of which is preferably arranged according to whether the device is adapted to only internal rotator or external rotator exercising, or whether both of the muscle groups can be exercised by the device. The elbow supports are arranged to the end of the motion shafts such that the elbow of the user is aligned with the pivot axis A of the pivot element 10.

By using a device according to the present invention, so-called internal and external rotation exercises can be executed. The exercises can be executed either with just one hand, or with both hands simultaneously. The motion is performed by using the forearm to move the elbow support 8 and the motion shaft 7 around the pivot axis A of the pivot element 10. The motion shaft is preferably disposed to the external edge of the substantially circular-shaped pivot element 10, and it makes a circular path at a distance from the pivot axis A equal to the radius of the pivot element. In internal rotation exercises, the motion of the motion shafts and the elbow supports is directed such that the internal rotators will activate, and, in external rotation exercises, the motion is, in turn, directed such that the external rotators will activate. The greatest possible motion range is from −40° to +105°, i.e. in total 145°. The zero point is defined such that, if the upper arm were tight against the side, then when the elbow is at a 90° angle in relation to the upper arm, it would point directly forward. Thence internal rotation, i.e. towards the frame of the device, is the negative direction and external rotation, i.e. away from the frame of the device, is the positive direction.

The angle between the upper arm and the body is in both internal and external rotation exercises 60°±5°. This is achieved such that the angle $\alpha$ between the imaginary extension, extending towards the frame, of the pivot axis (A) of each pivot element (10) of the device and the plane travelling through the midline (L) of the frame is 60°±5°. This is especially important in order that the exercise can be directed as precisely as possible into the subscapularis muscle (m. subscapularis). If the upper arm is closer to the body, the larger and more powerful internal rotators of the upper arm (greater pectoral muscle, latissimus dorsi muscle) will activate more, and it is not possible to direct the exercise onto the targeted small muscles of the shoulder region. Secondly, when the abduction of the upper arm is greater than 60 degrees, many shoulder patients experience pain in the shoulder joint.

Viewed from above, the pivot axis A of the pivot element 10 is arranged in the frontal plane such that the angle $\beta$ between the imaginary extension, extending towards the frame, of the pivot axis A of each pivot element 10 and the transverse midline H perpendicular in relation to the vertical direction of the frame is 60°±5°. In this case, as the elbow is leaning into the elbow support, the upper arm forms a 30 degree (±5°) angle with the imaginary extension of the shoulder line. The upper arm thus does not therefore point directly to the side, rather slightly forwards, parallel with the joint cavity in the shoulder blade. In this position, the spherical end of the shoulder bone has as much space as possible to move in its cavity. This is therefore the anatomically optimal angle for executing shoulder region exercises and especially important for the rehabilitation specifically of shoulder patients to minimize possible pain.

In order for the exercise to be safe, comfortable and effective, the axis of the motion shaft 7 must preferably be precisely aligned with the upper arm. This is enabled by the height adjustment of the seat 1 as well as the depth adjustment of the backrest 2. The length of the upper arm varies according to the height of the person. For this reason, the motion shafts must be adjustable in the direction of depth. Preferably, this adjustment takes place automatically. Very preferably, the motion shafts have a spring mechanism (not shown), which keeps the motion shaft 7 via the elbow support 8 tight against the elbow. The spring mechanism is preferably arranged to the attachment point between the motion shaft 7 and the pivot element 10. However, the motion shaft must not push the upper arm towards the cavity of the shoulder joint, thus measurement of the force of the spring mechanism must be precisely planned.

Preferably, also the longitudinal axes C of the elongated shaft portions 9 of the frame 1*a* are parallel with the pivot axes A of the pivot elements 10. The pivot element 10 attaches to the frame 1*a* of the device 1 via an elongated shaft 9, and it is preferably disposed to a projection 9*a* at the end of the elongated shaft 9 and crosswise in relation to the shaft 9. The attachment of the pivot element 10 to the elongated shaft portion 9 or to its possible projection 9*a*, the attachment of the possible projection 9*a* to the shaft portion 9, and the attachment of the shaft portion 9 to the frame 1*a* can be implemented by many ordinary manners of attachment, for example, by welding, or by nuts and bolts.

The use of eccentric exercise, i.e. negative muscle work, in rehabilitation has been researched a great deal in recent years. Eccentric exercise has also produced good results in shoulder region rehabilitation. Because the muscle produces greater forces eccentrically than concentrically or isometrically, the load to be used must be greater than in normal concentric-eccentric exercise. In a device according to the present invention, force transfer enables eccentric exercise such that the load is taken upwards with two hands and brought down with braking force performing eccentric work with one hand. The load can even be double in comparison to concentric exercise.

External rotation exercise of the shoulder seeks to target primarily the infraspinatus muscle (m. infraspinatus) as well as the teres minor muscle (m. teres minor). The rearmost portion ("deltoid posterior head") of the three-headed deltoid muscle (m. deltoideus) also promotes the motion.

An attempt has been made to minimize the number of adjustments affecting the exercise position and they are preferably adjusted automatically by means of an electric motor. The elbow support adjustment is preferably implemented by a self-adjusting mechanism solution, such as a spring mechanism.

To the device are preferably arranged means for transmitting pre-stored information about the user to an apparatus, as well as means for automatically adjusting at least one element, motion shaft, elbow support, load or other part of the device on the basis of the stored information.

The exercise information of the user, such as the exercise position adjustment information, number of series, repetitions, the motion range (starting and ending angle), the load and the execution speed of the motion, is stored in the memory of the device, or preferably in a cloud service, or in another corresponding external memory of the device, from which the exercise information is retrieved on the basis of the identification of the user, for example, as the user signs into the exercise device using a RFID card.

To the device are preferably also arranged means for collecting information about the exercise, as well as means for storing the information. Preferably, the information regarding an execution can be collected, for example, approx. 50 times per second via the force and angle sensors. Using this information, isometric measurements can be performed, which are useful for diagnostics as well as for monitoring rehabilitation. The information is stored in the memory in the device, or preferably in a cloud service or a corresponding external memory of the device.

As the load, the device preferably has a weight stack comprised of weight slabs. Such a weight stack is per se entirely prior known, and it is not presented in more detail in this connection. The load is transmitted into the motion shafts via force transfer. A substantial portion of the force transfer is a so-called cam (not shown), due to which the magnitude of the load changes as the motion shaft moves. The cam is preferably located within the weight stack frame. A cam designed with extremely great precision enables the safe, controlled and efficient exercise over the entire motion range. The load to be used in the exercise is selected by moving the selection peg of the weight stack, placing it between the weight slabs into the desired site. Also other type of solutions well known in the field can be considered for use as the load, such as a hydraulic or electrical resistance.

Adjustment of the starting angle of a motion is performed by means of a lever above the weight stack. By squeezing the lever and moving it up or down, the motion shafts move. When the squeezing of the lever is released, the motion shafts lock and define thus the starting angle of the motion. Such a lever is per se prior known, and it is not presented in more detail in this connection.

By using a device according to the present invention, the internal and external rotation exercises of the shoulder can be executed safely and effectively with optimal joint angles and loads. Joint angles are defined on the basis of an extensive review of the literature as well as of our own measurements. Optimal joint angles together with a motion shaft supporting the forearm precisely direct activation into the desired small muscles and the large, powerful muscles are not able to assist them in executing the motion. Secondly, optimal joint angles enable a vast group of rehabilitees, because the selected joint angles produce almost no pain for shoulder patients. Also, exceptionally important for rehabilitating sore shoulders is a precisely planned load curve, which enables the motion to be executed in a controlled manner over the entire motion range.

The invention claimed is:

1. A rehabilitation device adapted for rehabilitating and/or exercising a shoulder region of a user, the rehabilitation device comprising:

a frame;

support elements coupled to the frame and respectively configured to enable an upright position of an upper body of the user during the exercising;

a pair of elongated shaft portions coupled to the frame and respectively arranged on opposing sides of a vertical midline of the frame;

a pair of pivot elements respectively coupled to a distal end of each elongated shaft portion;

a pair of motion shafts respectively coupled to each pivot element;

a pair of elbow supports respectively coupled to a proximal end of each motion shaft; and shoulder supports coupled to the frame and respectively configured to hold a shoulder position of the user stationary during the exercising;

wherein the motion shafts and the elbow supports are respectively movable by the pivot elements;

wherein an angle $\alpha$ is defined between an imaginary extension, extending towards the frame, of a pivot axis of each of the pivot elements and a vertical plane through the vertical midline of the frame, the angle $\alpha$ being 60 degrees ±5 degrees; and wherein an angle $\beta$ is defined between the imaginary extension, extending towards the frame, of the pivot axis of each of the pivot elements and an imaginary extension of a transverse midline of the frame perpendicular to the vertical midline of the frame, the angle $\beta$ being 60 degrees ±5 degrees.

2. The rehabilitation device according to claim 1, wherein a longitudinal axis of each of each motion shaft and/or a longitudinal axis of each elongated shaft portion is/are oriented parallel with the pivot axis of the pivot element located on a corresponding same side of the vertical midline of the frame.

3. The rehabilitation device according to claim 1, further comprising means for transmitting stored information to an apparatus and means for automatically adjusting at least one of the support elements, the motion shafts, the elbow supports, a load or another part of the rehabilitation device based upon the stored information.

4. The rehabilitation device according to claim 3, wherein the stored information is stored in a cloud service, the stored information containing personal information of the user for adjusting the rehabilitation device.

5. The rehabilitation device according to claim 1, further comprising means for performing isometric measurements.

6. The rehabilitation device according to claim 1, wherein the rehabilitation device is adapted to activate specifically an infraspinatus muscle (m. infraspinatus) and a teres minor muscle (m. teres minor) of the user.

7. A method of exercising the shoulder region of the user on the rehabilitation device according to claim 1, the method comprising the steps of:

positioning an elbow and forearm of the user into one of the elbow supports such that an upper arm of the user forms, as viewed from above, a 30 degree angle with a line aligned with a shoulder of the user and, as viewed from a front perspective, a 60 degree angle with the user's body; and using the user's forearm to move the one of the elbow supports and the corresponding motion shaft around the pivot axis of the corresponding pivot element towards the frame of the rehabilitation device or away from the rehabilitation device.

* * * * *